US006107742A

United States Patent [19]

Seki et al.

[11] Patent Number: 6,107,742

[45] Date of Patent: Aug. 22, 2000

[54] METAL HALIDE LAMP

[75] Inventors: Tomoyuki Seki, Kyoto; Kenji Akiyoshi, Osaka; Akira Mii, Hyogo, all of Japan

[73] Assignee: Matsushita Electronics Corporation, Osaka, Japan

[21] Appl. No.: 09/053,338

[22] Filed: Apr. 1, 1998

[30] Foreign Application Priority Data

Apr. 3, 1997 [JP] Japan ..... 9-084991

[51] Int. Cl.[7] ..... H01J 61/20

[52] U.S. Cl. ..... 313/639; 313/637; 313/640; 313/641; 313/642

[58] Field of Search ..... 313/640, 641, 313/642, 643, 570, 571, 637, 639, 638

[56] References Cited

U.S. PATENT DOCUMENTS

| | | | |
|---|---|---|---|
| 3,654,506 | 4/1972 | Kuhl et al. | 313/641 |
| 3,781,586 | 12/1973 | Johnson | 313/570 |
| 4,988,918 | 1/1991 | Mori et al. | 313/641 |
| 5,138,227 | 8/1992 | Heider et al. | 313/640 |
| 5,451,838 | 9/1995 | Kawai | 313/571 |
| 5,668,441 | 9/1997 | Genz | 313/641 |

*Primary Examiner*—Ashok Patel

*Attorney, Agent, or Firm*—Merchant & Gould P.C.

[57] ABSTRACT

A metal halide lamp comprises a pair of electrodes and a discharge vessel filled with at least one metal halide comprising at least one rare earth metal halide, halogen in excess of the stoichiometry of the metal halide(s), mercury, and a rare gas. The amount of the mercury is between 7.7 mg/cc and 9.9 mg/cc, the excess halogen is 25–100% (in terms of atoms) of the halogen included in the metal halide(s), and the rated tube power for 200V rated tube voltage is 2000 W–3000 W.

9 Claims, 2 Drawing Sheets

METAL HALIDE LAMP

FIELD OF THE INVENTION

The present invention relates to a metal halide lamp.

BACKGROUND OF THE INVENTION

Single-tube high-wattage short-arc metal halide lamps with 2000 W–3000 W power rating, which are one class of high-intensity-discharge (HID) lamps, can be suitably used for compact fixtures, because they are compact lamps due to their single-tube structure. They are especially advantageous for use in lighting facilities of a sports stadium or the like, where they can contribute to the reduction of construction costs. Light control is easy because of the short-arc characteristics and it is possible to keep the amount of light leaking from the stadium area to a minimum and use an illumination design that prevents light pollution. Therefore, single-tube high-wattage short-arc metal halide lamps are widely used for out-door illumination of sports grounds.

However, since such metal halide lamps do not have an outer tube, there is the danger that fragments of the discharge vessel may scatter into the inside of the appliance or fixture when the discharge vessel is damaged for some reason while the lamp is turned on, collide with the appliance or fixture and damage its shield glass.

In order to reduce the shock of such an impact, usually the mercury density in the discharge vessel of the burning single-tube high-wattage short-arc metal halide lamp is reduced to decrease the internal pressure of the discharge vessel. Since reduction of the mercury density also lowers the lamp voltage, lamps with a lamp voltage of 100V rated tube voltage are widely used.

In conventional single-tube high-wattage short-arc metal halide lamps with 100V rated tube voltage however, the tube current in the case of 2000 W tube power becomes about 20 A and tube current in the case of 3000 W tube power becomes about 30 A. Thus, the current becomes quite large.

A single-tube high-wattage short-arc metal halide lamp has a pair of electrodes in the discharge vessel, and lamp shafts into which a feedthrough has been sealed are connected to both sides of this discharge vessel. The feedthroughs comprise a conductive foil of molybdenum connected to a lead rod. In the feedthroughs, heat is released at the conductive foil and the lead rod as well as at the junction of the conductive foil and lead rod, because at 2000 W and 3000 W power dissipation the tube current is rather high with 20 A or 30 A respectively. The feedthroughs can deteriorate by oxidation due to this heat release, so that the life expectancy of the lamp is shortened.

In order to overcome these problems of the prior art, it is a purpose of the present invention to provide a metal halide lamp for a rated voltage of 200V that has a low internal pressure in the discharge vessel when the lamp is burning and does not harm the appliance or fixture even when the discharge vessel is damaged while the lamp is burning.

SUMMARY OF THE INVENTION

In order to achieve the above purpose, a metal halide lamp according to the present invention comprises a pair of electrodes and a discharge vessel filled with at least one metal halide comprising at least one rare earth metal halide, halogen in excess of the stoichiometry of the metal halide(s), mercury, and a rare gas. The amount of the mercury is 7.7 mg/cc–9.9 mg/cc, the excess halogen is 25–100% (in terms of atoms) of the halogen included in the metal halide(s), and the rated tube power for a 200V rated tube voltage is 2000 W–3000 W.

It is preferable that the amount of the mercury in the metal halide lamp is 8.2 mg/cc–9.3 mg/cc and that the excess halogen is 43–81% (in terms of atoms) of the halogen included in the metal halide(s). Providing this amount of mercury compensates the increase of the critical voltage below which the arc extinguishes, which is caused by the increase of the necessary lamp voltage accompanying the lamp's usage. This warrants sufficient arc stability and prolongs the lifespan of the lamp.

It is preferable that the metal halide(s) comprise at least one rare earth metal halide selected from the group consisting of Dy, Tm and Ho, at least one element selected from the group consisting of Tl and Cs, and at least one halogen.

It is preferable that the halogen atoms are enclosed in the discharge vessel in form of metal halide and mercury halide, and the excess halogen is generated from the mercury halide. The excess halogen is generated by dissociation from the mercury halide at the time of use of the lamp.

It is preferable that the halogen atoms comprise at least one element selected from the group consisting of bromine and iodine.

It is preferable that the halogen atoms comprise bromine and iodine, and that the ratio of the amount of bromine (expressed in mol) to the amount of iodine (expressed in mol) is 2:1. This leads to advantageous properties, where neither a decrease of the light flux due to blackening while the lamp was in use nor electrode break-off occurs, which may shorten the lamp's lifespan.

It is preferable that the rare gas is argon gas.

In such a metal halide lamp, the tube current at a 200V rated tube voltage and 2000 W rated tube power can be kept at 10 A. The tube current at 200V rated tube voltage and 3000 W rated tube power can be kept at 15 A.

It is preferable that the internal pressure of the burning light emitting tube is 7.7–9.9 atm (kg/cm$^2$).

As has been pointed out above, the metal halide lamp according to the present invention comprises a pair of electrodes in an internal portion and a discharge vessel that is filled with mercury, a rare gas, at least one metal halide comprising at least one rare earth metal halide, and halogen in excess of the stoichiometry of the metal halide(s), wherein the amount of the mercury M (in mg/cc) is $9.9 \geqq M \geqq 7.7$, the enclosed excess halogen is 25–100% (in terms of atoms) of the halogen included in the metal halide(s), and the rated tube power for a 200V rated tube voltage is 2000 W–3000 W.

Therefore, employing a rated tube voltage of 200V, the lamp current at 2000 W and 3000 W rated power can be decreased to 10 A and 15 A respectively, and the internal pressure in the discharge vessel when the lamp is burning can be reduced. Thus, the appliance or fixture is not harmed if by any chance the discharge vessel is damaged while the lamp is burning, because the impact of a fragment on the appliance or fixture is small.

DESCRIPTION OF THE PREFERRED EMBODIMENTS

EXAMPLE

Figure 1:
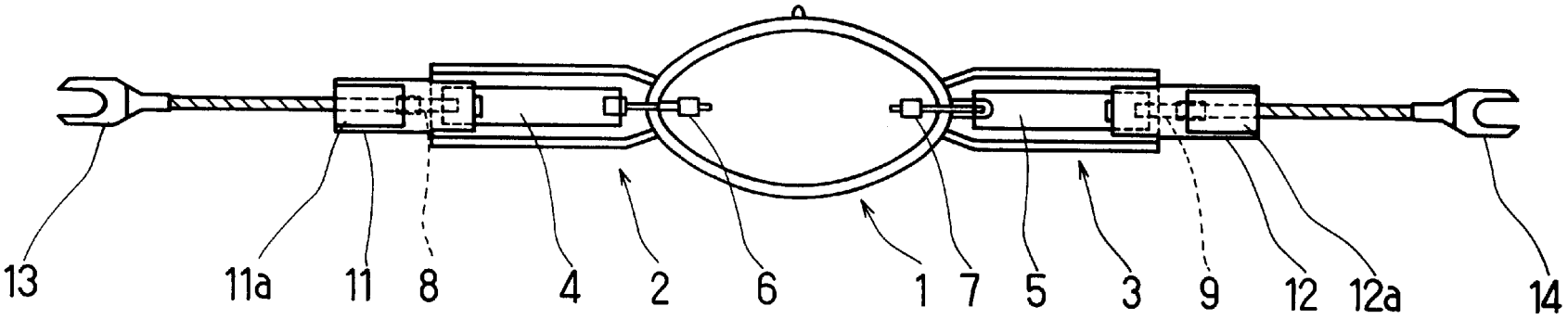
FIG. 1 shows a front view of a single-tube high-wattage short-arc metal halide lamp according to an example of the present invention.

As shown in FIG. 1, the single-tube high-wattage short-arc metal halide lamp according to this example of the present invention comprises lamp shafts 2 and 3, which are connected to both ends of a discharge vessel 1 that is made of quartz glass. The lamp shafts 2 and 3 are formed into a flat shape by pinch-sealing. Molybdenum foils 4 and 5, which are connected on one end to electrodes 6 and 7, are sealed into the lamp shafts 2 and 3. Outer lead rods 8 and 9 are connected to one end of each molybdenum foil. The molybdenum foils 4 and 5 and one end of the outer lead rods 8 and 9 are sealed into the lamp shafts 2 and 3. The other end of the outer lead rods is guided to the outside of the lamp shaft. Thus, each molybdenum foil and one end of each outer lead rod are sealed into the lamp shaft. However, during the sealing process, a tiny gap is formed along the outer lead rod into the lamp shaft. Air reaches the molybdenum foils from outside the discharge vessel through this gap, so that the molybdenum foils are exposed to air. Moreover, the cement for fastening the base to the lamp shaft is not airtight. The maximum thickness of the molybdenum foils 4 and 5 is 50 $\mu$m.

The two electrodes 6 and 7 oppose each other inside the discharge vessel 1. The distance between the electrodes 6 and 7 is 30 mm. The other ends of the molybdenum foils 4 and 5, which lead out of the lamp shafts 2 and 3, are connected to connection terminals 13 and 14 respectively via outer lead rods 8 and 9 embedded in caps 11 and 12 made of ceramic. The end of the caps 11 and 12 are flattened and these flattened portions are plugs 11*a* and 12*a* for installation in the appliance (not shown).

Figure 2:
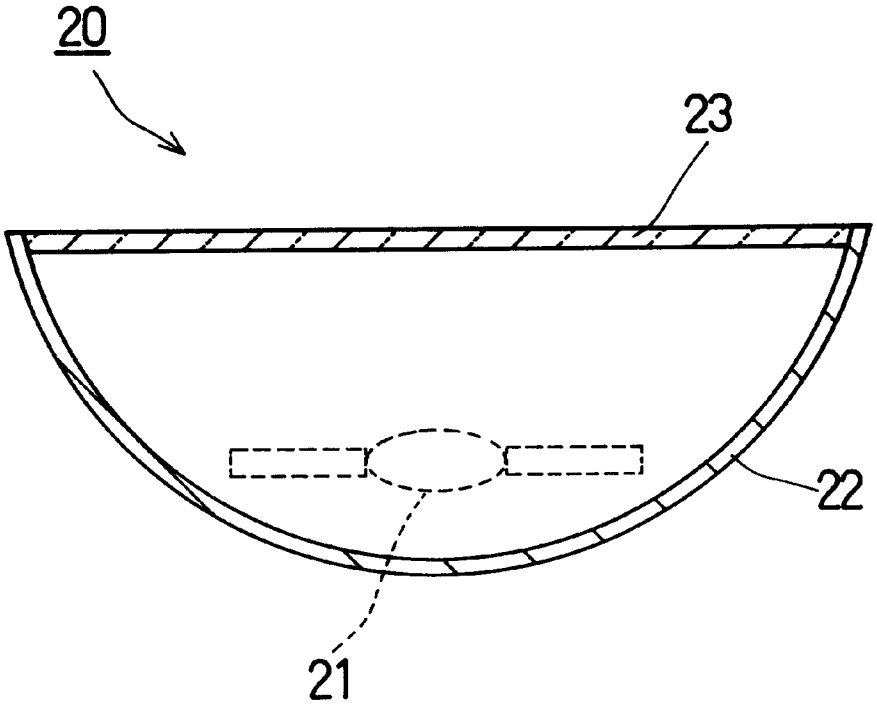
FIG. 2 shows a side view of a fixture that incorporates the metal halide lamp according to an example of the present invention.

FIG. 2 shows a side view of a fixture that incorporates the metal halide lamp according to an example of the present invention. The metal halide lamp 21 is installed in a lamp fitting 22 of the fixture, which comprises a front glass 23.

The discharge vessel 1 is a spheroid of 22 cc internal volume with a maximum outer diameter of 35 mm and is filled with 10 kPa rare gas (argon) for ignition, 194 mg mercury, metal halides including at least one halide selected from the group of rare earth metal halides as luminescent material and 62% (in terms of atoms) halogen in excess of the stoichiometry of said metal halide. The metal halides comprise halides of the rare earth metals Dy, Tm and Ho and halides of Tl and Cs. The enclosed amounts (in mol) of Dy, Tm and Ho are equal and the total enclosed amount of rare earth metal halides is 30 $\mu$mol. The enclosed amount of Tl halides is 7 $\mu$mol and that of the Cs halides is 40 $\mu$mol. The halogen atoms in the discharge vessel comprise bromine and iodine. The ratio of the amount of bromine atoms (expressed in mol) to the amount of iodine atoms (expressed in mol) is 2:1. The halogen atoms are enclosed in the discharge vessel in the form of metal halides, especially mercury halides, and the excess halogen is generated from the mercury halide. The excess halogen is generated by dissociation from the mercury halide at the time of use of the lamp.

In the present example, the amount of mercury M enclosed in the discharge vessel 1 is expressed in g/cc and the excess halogen X is expressed in percent (of atoms), taking the total number of halogen atoms contained in the metal halides as 100%. The lamp was installed in a small-size lighting equipment 20, which has a front face with a diameter of 47 cm (and a flooding surface of about 1740 $cm^2$), and lighted with a tube voltage of 205V and a tube power of 1950 W. A heat-resistant glass of 5 mm thickness was used as the front face glass. The internal pressure of the light emitting tube when turned on was 7.7–9.9 atm.

Table 1 shows the amount of mercury M (in g/cc), the amount of excess halogen X (in atom %), the glass damage caused by a purposely damaged lamp, and the burning quality when the stabilizer was short-circuited so that momentarily a very large current flows and the lamp is purposely damaged, after the lamp has burned sufficiently stable in the lighting equipment. In Table 1, an acceptable result is indicated by a circle (○) and a non-acceptable result is indicated by a cross (×).

TABLE 1

| M (in g/cc) | x (in atom %) | Damage of the Front Glass | Lamp Burning Quality | Result |
|---|---|---|---|---|
| 6.6 | 138 | N/A | Extinguished | x |
| 7.1 | 118 | No | Unstable | x |
| 7.7 | 100 | No | Sustained | ○ |
| 8.2 | 81 | No | Sustained | ○ |
| 8.8 | 62 | No | Sustained | ○ |
| 9.3 | 43 | No | Sustained | ○ |
| 9.9 | 25 | No | Sustained | ○ |
| 10.4 | 13 | Yes | Sustained | x |
| 11.5 | 7 | Yes | Sustained | x |
| 12.5 | 0 | Yes | Sustained | x |

As becomes clear from Table 1, at $9.9 \geqq M \geqq 7.7$ and an excess halogen of 25–100% (in terms of atoms) against the halogen in the metal halides, the lamp burns steadily, and even when the lamp is damaged, the front glass of the lighting equipment is not harmed. The characteristics were particularly favorable when the amount of mercury was 8.2 mg/cc–9.3 mg/cc. Also, when the excess halogen was 43–81% (in terms of atoms) of the halogen in the metal halides, the lamp characteristics were particularly favorable.

When the amount of mercury M was below 7.7 and the excess halogen was 118–138% (in terms of atoms) of the halogen in the metal halides, then the front glass was not damaged after the light-emitting tube was purposely damaged, but before purposely damaging the light-emitting tube, that means in the regular burning state, the burning was unstable or the arc broke down. When the amount of mercury M exceeded 9.9 and the excess halogen was 13–0% (in terms of atoms) of the halogen in the metal halides, the regular burning condition of the lamp could be sustained before the light-emitting tube was purposely damaged, but after the light-emitting tube was purposely damaged, damage of the front glass was incurred by fragments of the light-emitting tube.

The present example refers to a lamp with 1950 W tube power, but using a lamp with 3000 W tube power, the same results were attained. The increase of the critical voltage below which the lamp arc extinguishes, which is caused by the increase of the lamp voltage while the lamp is in use, was compensated. The lamp characteristics were favorable in that sufficient arc stability is provided, and the lamp was not damaged during its lifespan.

The present invention provides a metal halide lamp, whose lamp current at rated powers of 2000 W or 3000 W is relatively low at 10 A or 15 A respectively, because the rated lamp voltage is 200V. Even though the rated voltage is 200V, the internal pressure in the discharge vessel when the lamp is burning is low, and the fixture is not harmed when the discharge vessel is damaged while the lamp is burning, because the impact of fragments is small. The lamp has an excellent life expectancy, since deterioration due to oxidation of the junctions between the conductive foils and the lead rods does not shorten the lamp's life.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A metal halide lamp comprising a pair of electrodes and a discharge vessel filled with:

at least one metal halide comprising at least one rare earth metal halide;

halogen in excess of the stoichiometry of said metal halide(s);

mercury; and a rare gas;

wherein the amount of said mercury is between 7.7 mg/cc and 9.9 mg/cc, said excess halogen is 25–100% (in terms of atoms) of the halogen included in said metal halide(s), and the rated tube power for a 200V rated tube voltage is 200 W–3000 W, and wherein said metal halide comprises at least one rare earth metal selected from the group consisting of Dy, Tm and Ho, at least one element selected from the group consisting of Tl and Cs, and at least one halogen.

2. The metal halide lamp according to claim 1, wherein the amount of said mercury is between 8.2 mg/cc and 9.3 mg/cc and said excess halogen is 43–81% (in terms of atoms) of the halogen included in said metal halide(s).

3. The metal halide lamp according to claim 1, wherein the halogen atoms are enclosed in the discharge vessel in form of metal halide and mercury halide, and the excess halogen is generated from the mercury halide.

4. The metal halide lamp according to claim 1, wherein the halogen atoms comprise at least one element selected from the group consisting of bromine and iodine.

5. The metal halide lamp according to claim 1, wherein the halogen atoms comprise bromine and iodine, and the ratio of the amount of bromine expressed in mol to the amount of iodine expressed in mol is 2:1.

6. The metal halide lamp according to claim 1, wherein the rare gas is argon gas.

7. The metal halide lamp according to claim 1, wherein the tube current at 200V rated tube voltage and 2000 W rated tube power is 10 A.

8. The metal halide lamp according to claim 1, wherein the tube current at 200V rated tube voltage and 3000 W rated tube power is 15 A.

9. The metal halide lamp according to claim 1, wherein the internal pressure of the burning light emitting tube is 7.7–9.9 atm.

* * * * *